US011746530B2

(12) United States Patent
Rogers et al.

(10) Patent No.: US 11,746,530 B2
(45) Date of Patent: Sep. 5, 2023

(54) MULTIPLE ROOF CURBS FOR SUPPORTING A ROOFTOP MECHANICAL UNIT

(71) Applicant: AUSTIN BUILDING AND DESIGN INC., Cleveland, OH (US)

(72) Inventors: Barry A. Rogers, Novelty, OH (US); Jeffrey J. Morris, Streetsboro, OH (US); Alex Sestak, North Ridgeville, OH (US)

(73) Assignee: AUSTIN BUILDING AND DESIGN INC., Cleveland, OH (US)

( * ) Notice: Subject to any disclaimer, the term of this patent is extended or adjusted under 35 U.S.C. 154(b) by 126 days.

(21) Appl. No.: 17/336,819

(22) Filed: Jun. 2, 2021

(65) Prior Publication Data

US 2021/0404186 A1 Dec. 30, 2021

Related U.S. Application Data

(60) Provisional application No. 63/046,005, filed on Jun. 30, 2020.

(51) Int. Cl.
*E04D 13/14* (2006.01)

(52) U.S. Cl.
CPC ..... *E04D 13/1407* (2013.01)

(58) Field of Classification Search
CPC ..... E04F 13/1407; E04F 13/0315; E04F 13/1475; F24F 13/32; F24F 13/20; F24F 13/30; F24F 13/0209
USPC ..... 52/219
See application file for complete search history.

(56) References Cited

U.S. PATENT DOCUMENTS

| | | | | |
|---|---|---|---|---|
| 4,483,155 | A * | 11/1984 | Stiles | F24F 13/00 62/DIG. 16 |
| 5,582,026 | A | 12/1996 | Barto, Sr. | |
| 6,648,295 | B2 * | 11/2003 | Herren | F16F 15/0275 248/562 |
| 6,679,014 | B2 | 1/2004 | Hughes et al. | |
| 7,065,928 | B1 | 6/2006 | Lane et al. | |
| 7,277,627 | B2 * | 10/2007 | Hughes | F28D 20/0034 392/441 |
| 7,712,279 | B2 | 5/2010 | McClure | |
| 8,360,834 | B1 | 1/2013 | Semmes | |
| 8,701,355 | B2 | 4/2014 | Sexton | |
| 9,027,901 | B2 | 5/2015 | Pooler | |
| 9,151,057 | B2 | 10/2015 | Mills et al. | |
| 9,249,980 | B2 | 2/2016 | Tollar | |
| 9,291,356 | B2 | 3/2016 | Demster | |
| 9,546,485 | B2 | 1/2017 | Mills et al. | |
| 9,933,183 | B1 | 4/2018 | Den Adel | |
| D907,191 | S | 1/2021 | Reap | |
| 10,890,352 | B2 * | 1/2021 | Carton | F24F 13/28 |
| 11,236,928 | B2 * | 2/2022 | Tamboli | F24F 13/20 |
| 11,261,604 | B1 * | 3/2022 | Green | E04D 13/1415 |

(Continued)

*Primary Examiner* — Beth A Stephan
(74) *Attorney, Agent, or Firm* — Pearne & Gordon LLP; Bryan T. Fink

(57) ABSTRACT

A building including a roof and a rooftop mechanical unit, the rooftop mechanical unit being supported on top of the roof by at least a first roof curb and a second roof curb, a gap being provided between the roof curbs, each of the roof curbs being less than 15 feet in length; wind can blow snow through the gap and out the other side, which inhibits the buildup of a snowdrift which undesirably increases roof load.

17 Claims, 4 Drawing Sheets

(56) References Cited

U.S. PATENT DOCUMENTS

| | | | | |
|---|---|---|---|---|
| 11,268,709 | B1 * | 3/2022 | Zeeff | F24F 1/40 |
| 2011/0073017 | A1 * | 3/2011 | Wilson, Jr. | F24F 13/32<br>248/346.03 |
| 2012/0193505 | A1 * | 8/2012 | Baron | F16F 15/06<br>248/636 |
| 2014/0075980 | A1 * | 3/2014 | Villar | F24F 13/32<br>62/297 |
| 2016/0344332 | A1 * | 11/2016 | Stearns | E04D 13/147 |
| 2021/0148602 | A1 * | 5/2021 | Michel | F24F 13/32 |
| 2021/0270475 | A1 * | 9/2021 | Haubrich | F24F 7/025 |
| 2022/0065493 | A1 * | 3/2022 | Chothave | F24F 13/222 |

* cited by examiner

MULTIPLE ROOF CURBS FOR SUPPORTING A ROOFTOP MECHANICAL UNIT

This application claims the benefit of U.S. Provisional Patent Application No. 63/046,005 filed on Jun. 30, 2020, the entire contents of which are incorporated herein by reference.

FIELD OF THE INVENTION

The invention is directed to a building having a rooftop mechanical unit supported by a plurality of roof curbs; the invention is particularly useful in areas subject to heavy snowfall.

DESCRIPTION OF RELATED ART

Current building codes include and define requirements for structural roof loads resulting from snow drifts for regions in the US subject to snow events or heavy or significant snowfall. The code requirements define increased roof loads due to snow drifts that occur adjacent to rooftop mechanical units that are 15 feet or more in length. A typical rooftop mechanical unit can be up to 20, 30, 40, 50 or 60 feet in length. The increased loads due to snow are often 3 to 4 times higher than the adjacent roof loads, and are additional to the weight of the rooftop unit itself. With reference to the prior art, FIG. 1 shows a building or facility having a flat roof 10 (including roof joists 11) supported by columns 9. Mounted on the roof 10 is a rooftop mechanical unit 12 (such as a fan, a ventilator, an air-conditioning unit, a refrigeration unit, a freezer unit, an air handling unit, an air makeup unit, a heat recovery unit, or a pollution control unit) mounted on a standard or conventional roof curb 16 as known in the art. The roof curb 16 is preferably a raised metal frame made preferably of galvanized steel and looks like an empty box; FIG. 2 shows a typical roof curb 38 as known in the prior art. The roof curb 16 supports the rooftop mechanical unit 12 on the roof 10. The roof curb 16 preferably has a length and width the same as the length and width of the mechanical unit 12; typically there is a gasket where the perimeter of the roof curb joins the perimeter of the mechanical unit so as to seal the joint between the two; this minimizes the infiltration of precipitation etc. With reference to FIG. 1, there is shown a snow drift A which has accumulated adjacent to the mechanical unit 12 and roof curb 16. The height H of the snow drift where it contacts the rooftop mechanical unit 12 can be, for example, 5 feet; the weight of the snow in the drift can be, for example, 83 pounds per square foot; the mechanical unit 12 can have a length L, for example, of 30 feet; the distance D across the roof 10 to the mechanical unit 12 can be, for example, 300 feet; the width W of the snow drift at its base can be calculated, for example, as four times the height H, that is, 4×5 feet equals 20 feet; the total additional load due to the snow drift on one side of the mechanical unit 12 can be calculated, for example, as 12.5 tons. The calculation of snow drift weight is required on both sides of the mechanical unit, so that the total load in FIG. 1 can be, for example, 12.5×2=25 tons (ASCE7-10 Section 7.8). Building codes prior to about 1990 did not require consideration of snow drifts in the same manner, if at all, and many buildings that are now being modified were designed and constructed without this additional loading in mind. When building contractors are adding or replacing rooftop units on buildings designed prior to about 1990, they are required to deal with the increased and significant roof snow drift loads. One conventional solution for this requirement is the use of an elevated roof platform or roof grillage (illustrated in FIG. 3), which is elevated above the roof, and spans to where there are existing building columns, or new columns are added to the facility. These elevated roof platforms require walking surfaces, guardrails and access stairs for maintenance access to the mechanical equipment. For example, with reference to FIG. 3, there is shown a solution wherein the rooftop mechanical unit 12, such as an air-conditioning unit, is supported and elevated above the roof 10 by the elevated roof platform 14; in this construction, the elevated roof platform 14 is elevated and supported above the roof surface 10 by supports or posts at locations 24, 26, 28 and 30 where there are existing building columns 9 beneath. Except for the access stairs 32, snow has a substantially unrestricted ability to blow underneath the rooftop mechanical unit 12.

Another possible solution to the snow drift problem is to utilize compact rooftop equipment, for example, providing a larger number of smaller units, recognizing that units less than 15 feet in length do not require the consideration of additional snow drift load.

SUMMARY OF THE INVENTION

A building comprising a roof and a rooftop mechanical unit, the rooftop mechanical unit being supported on top of the roof by at least a first roof curb and a second roof curb, a gap being provided between the first roof curb and the second roof curb, each of the first roof curb and the second roof curb having a length, each of the first roof curb and the second roof curb being less than 15 feet in length. A method of providing a rooftop mechanical unit on a roof of a building is also provided.

DETAILED DESCRIPTION OF PREFERRED EMBODIMENTS OF THE INVENTION

As used herein, when a range such as 5 to 25 (or 5-25) is given, this means preferably at least 5, and separately and independently, preferably not more than 25.

Figure 2:
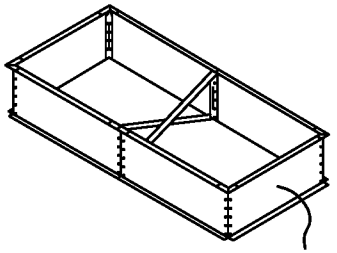
FIG. 2 PRIOR ART
FIG. 2 is a perspective view of a roof curb as known in the prior art.
Figure 1:
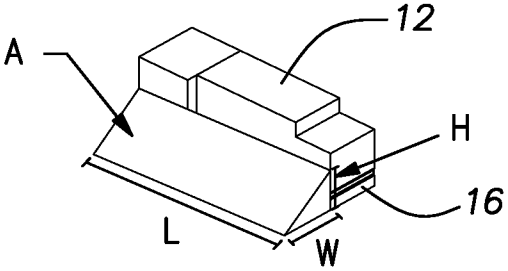
FIG. 1 PRIOR ART
FIG. 1 schematically illustrates an accumulation of snow in a snow drift adjacent a rooftop mechanical unit on a roof of a building.
Figure 1:
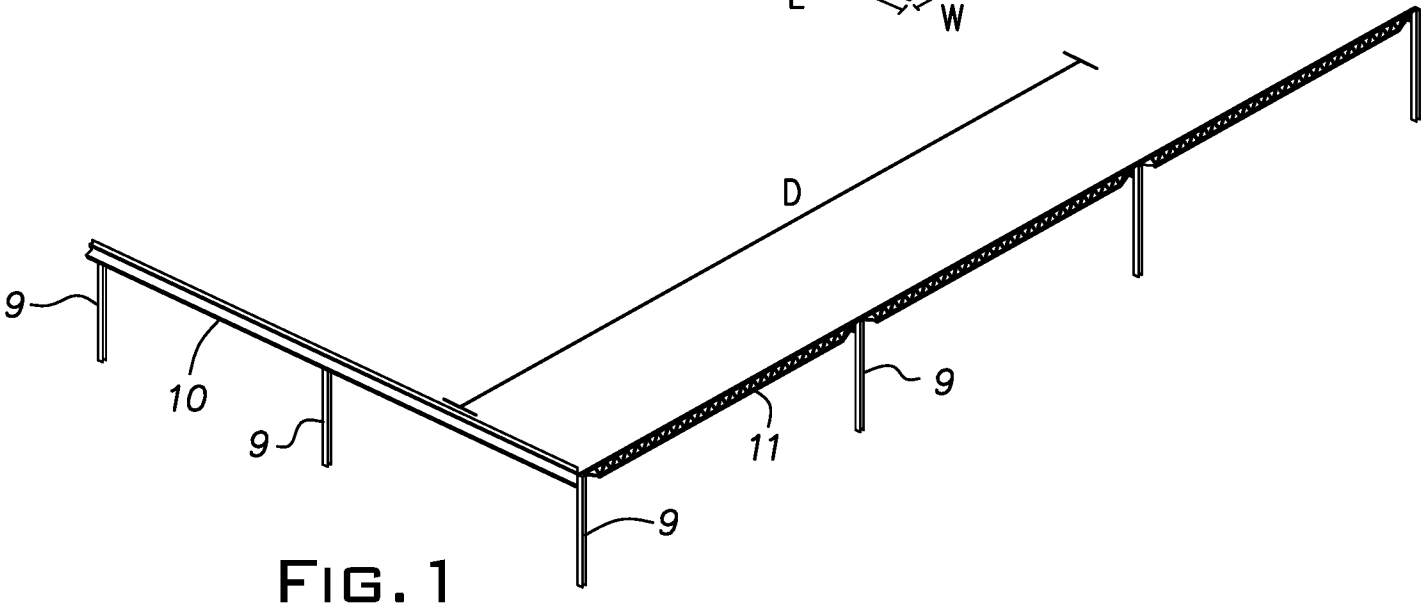
FIG. 1 PRIOR ART
Figure 3:
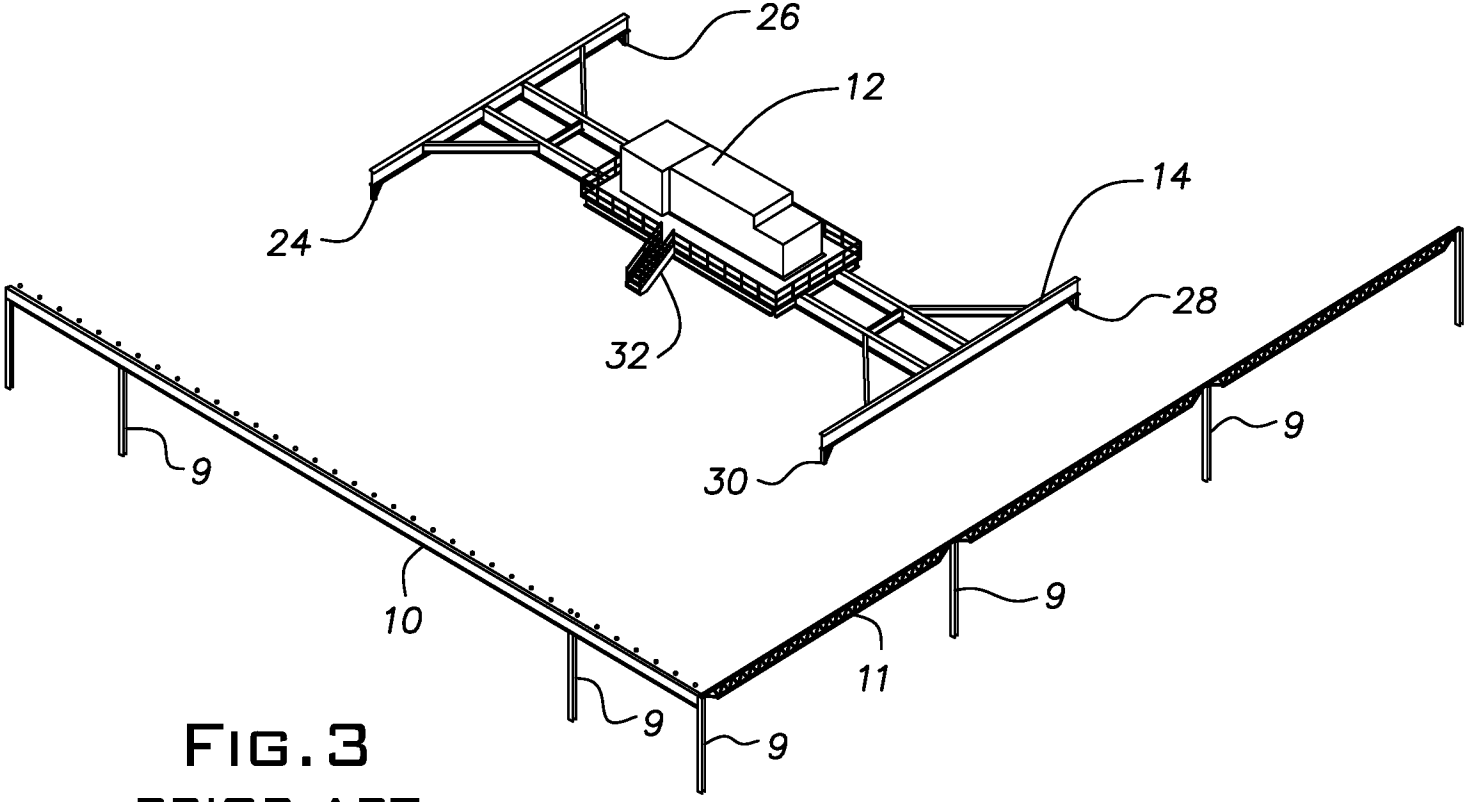
FIG. 3 PRIOR ART
FIG. 3 schematically illustrates an elevated roof platform according to the prior art.
Figure 4:
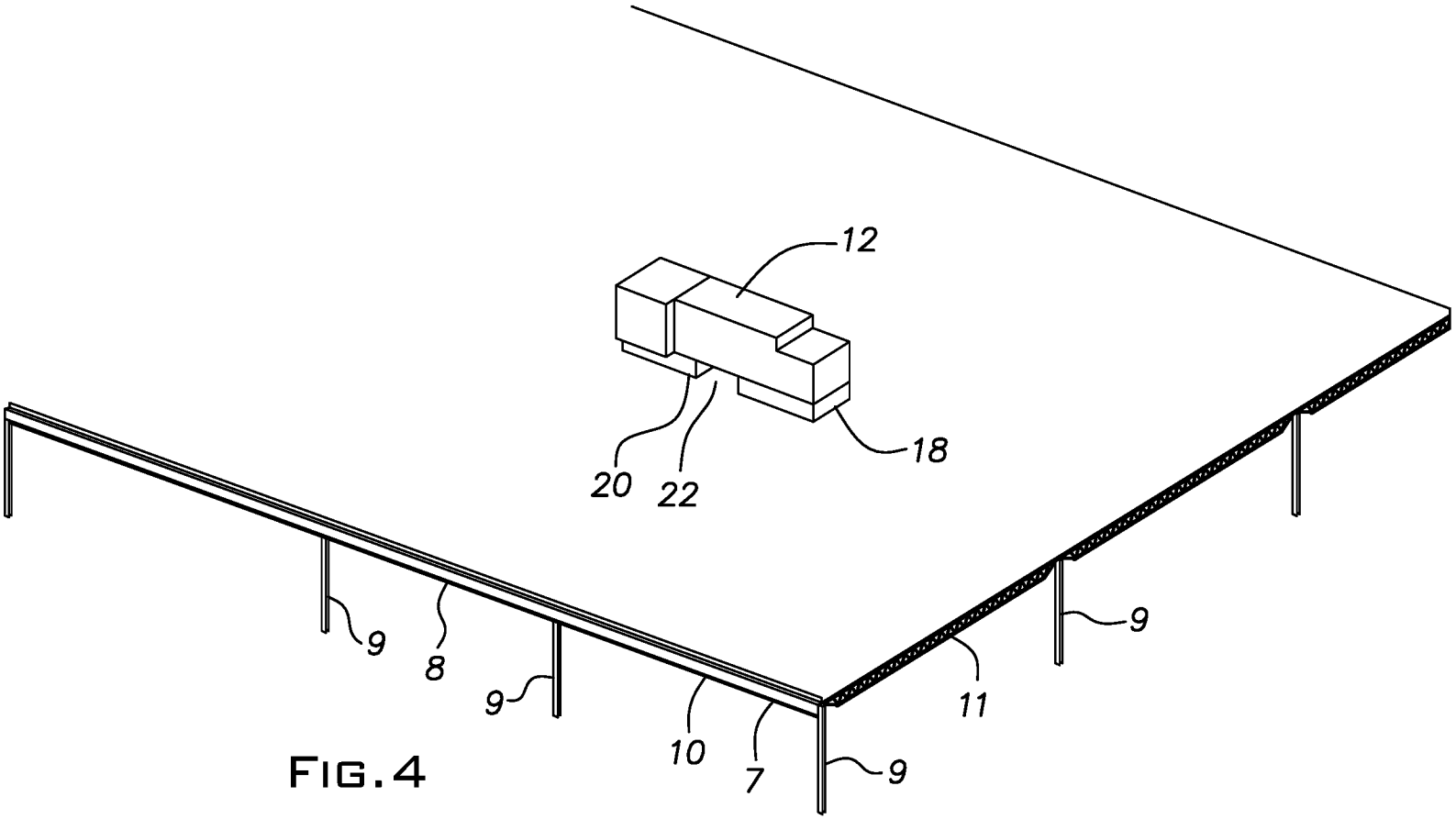
FIG. 4 schematically illustrates a rooftop mechanical unit mounted on a pair of roof curbs on a roof of a building according to the invention.
Figure 5:
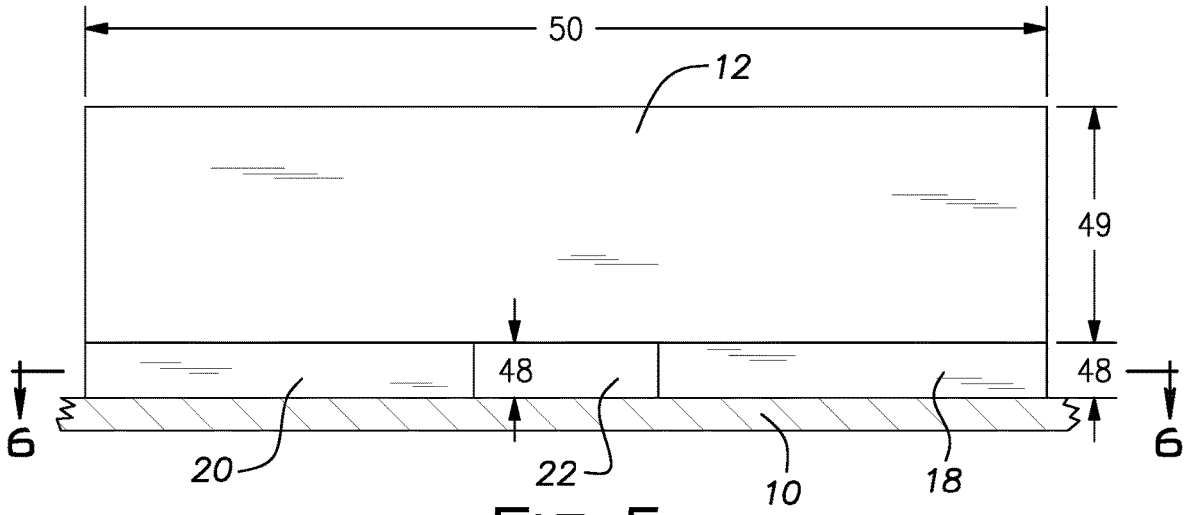
FIG. 5 is a front elevational schematic view, not to scale, of a rooftop mechanical unit mounted on a pair of roof curbs on a roof (shown in cross-section) according to the invention.
Figure 6:
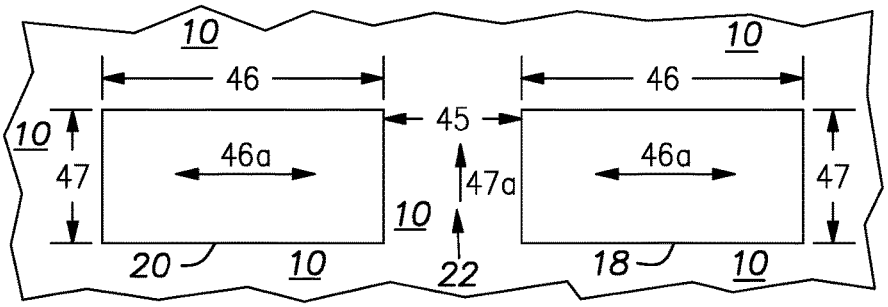
FIG. 6 is a top plan view, not to scale, taken along line 6-6 of FIG. 5.

With reference to FIGS. 4-6, there are shown embodiments of the present invention wherein the rooftop mechanical unit 12 is supported on a roof 10 of a building 8 by a first roof curb 18 and a second roof curb 20. The rooftop mechanical unit 12 can be provided during the construction of the building or during an addition of or a replacement of a rooftop mechanical unit on the roof of the building. The roof 10, which is conventional and known in the prior art, is preferably a flat roof, a low-slope roof, or a sloped roof, all as determined or defined in ASCE7-10 Chapter 7 (ASCE7-10 is published by the American Society of Civil Engineers, having an address at 1801 Alexander Bell Drive, Reston, Va. 20191 USA). Preferably, each of the rooftop mechanical unit 12, the first roof curb 18 and the second roof curb 20 is rectangular or substantially rectangular in plan view. The roof 10, which preferably comprises roof girders 7 and roof joists 11, is supported by columns 9, as known in the art. The building 8, which is conventional and known in the prior art, can be, for example, a manufacturing plant, a warehouse, a store, a commercial building, an industrial building, a residential apartment building, an office building, preferably an enclosed building, or any building which has one or more rooftop mechanical units on the roof. The building is preferably located or situated in an area having a ground snow load of at least 15, 20, 25, 30, 35, 40, 50 or 60 pounds per square foot; as used herein and in the claims, "ground snow load" means ground snow load as determined according to ASCE7-10 Section 7.2 and an area having a ground snow load of at least X pounds per square foot is an area having a ground snow load of at least X pounds per square foot as determined according to ASCE7-10 Chapter 7.

Each roof curb 18, 20 has a length 46 (the roof curbs 18, 20 can have the same length or different lengths) which is less than 15 feet, so that, under current building codes, snow drift load does not need to be considered. Preferably, the building 8 is situated in an area which is subject to a local building code which provides, for that building, that, but for each of said roof curbs being less than 15 feet in length, the roof 10 would have to be strengthened to support the addition of a drifted snow load. Each roof curb 18, 20 preferably has a width 47 the same as the width of the rooftop mechanical unit 12; the width 47 of each roof curb 18, 20 is typically 6 to 8 feet, preferably at least 6 feet and preferably not more than 9 feet, more preferably about 8 feet. Each roof curb 18, 20 has a length 46 which is preferably at least 8, 9, 10, 11, 12, 13, 14, 14.5 or 14.9 feet in length. Preferably each roof curb 18, 20 has a length 46 which is not more than 14.9, 14.8, 14.5, 14.2, 14, 13.5, 13, 12.5, 12, 11 or 10 feet. Each roof curb 18, 20 has a length extending in a longitudinal direction 46*a*, and, as can be seen in FIG. 6, the gap 22 extends between the roof curbs 18, 20 in a direction 47*a* transverse to said longitudinal direction 46*a*. Each roof curb 18, 20 is preferably hollow and is constructed as known in the prior art using materials as known in the prior art and is attached to the roof as known in the prior art and is attached and sealed to the rooftop mechanical unit 12 as known in the prior art.

Between the adjacent roof curbs 18 and 20 is a gap 22 which has a height 48 preferably at least 12, 14, 16, 18, 20, 22, 24, 26, 28, 30, 32 or 36 inches and preferably not more than 52, 48, 44, 40, 36, 34, 32, 30, 28, 26, 24, 22 or 20 inches. The height of the gap 22 is preferably at least 2, 4, 6 or 8 inches more than the height (if known) of the ground snow load for the region or location where the building is located. The gap 22 has a width 45 preferably at least 30, 36, 40, 44, 48, 52 or 56 inches and preferably not more than 106, 100, 96, 92, 88, 84, 80, 76 or 72 inches. The width 45 of the gap 22 optionally can be less than, or at least, 70, 60, 50, 40 or 30% of the length 47 of the tunnel between the adjacent roof curbs 18, 20; as can be seen in FIG. 6, gap 22 has a width 45 and a length 47. Each roof curb 18, 20, 38 is constructed as roof curbs known in the art are constructed. Each roof curb 18, 20 preferably has a height 48 as high as, or corresponding to, the preferred heights 48 of the gap 22 described above.

The rooftop mechanical unit 12, which is conventional and known in the prior art, is preferably a fan, a ventilator, an air-conditioning unit, a refrigeration unit, a freezer unit, an air handling unit, an air makeup unit, a heat recovery unit, or a pollution control unit (each of which is shown schematically as item 12 in FIG. 4), has a length 50 preferably at least 20, 25, 30, 35, 40, 45, 50 or 60 feet, preferably not more than 70, 60, 55, 50, 45, 40, 35 or 30 feet, has an average height 49 preferably at least 3, 4, 5 or 6 feet, preferably not more than 12, 11, 10, 9, 8 or 7 feet (wherein the average height 49 is the average of the heights along the length of the rooftop mechanical unit 12), and has a weight (per foot of length of the rooftop mechanical unit 12) preferably at least 70, 80, 90, 100, 125, 150, 200, 250, 300, 350 or 400 pounds and preferably not more than 750, 700, 650, 600, 550, 500, 450 or 400 pounds.

Figure 7:
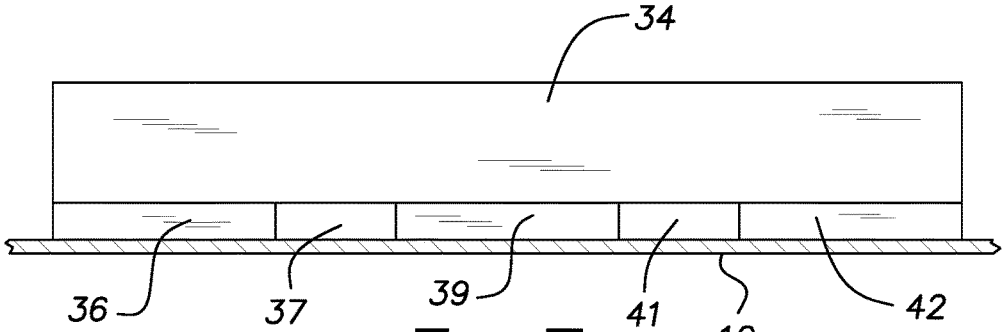
FIG. 7 is a front elevational schematic view, not to scale, of a rooftop mechanical unit mounted on three roof curbs on a roof (shown in cross-section) according to the invention.

When the rooftop mechanical unit is particularly long or for other reasons, more than 2 roof curbs can be used, such as 3 or 4 roof curbs, resulting in 2 or more gaps. For example, as shown in FIG. 7, there is a rooftop mechanical unit 34 supported by roof curbs 36, 39 and 42, resulting in gaps 37 and 41. Preferably, these roof curbs and gaps have the same dimensions as the roof curbs and gaps described above.

When a gap is provided between adjacent roof curbs, the wind can blow the snow through the gap and out the other side, which inhibits the buildup of snowdrifts.

Although the hereinabove described embodiments of the invention constitute the preferred embodiments, it should be understood that modifications can be made thereto without departing from the scope of the invention as set forth in the appended claims.

What is claimed is:

1. A building comprising a roof and a rooftop mechanical unit, the rooftop mechanical unit extending in a lengthwise direction and having a length and a width, the length being more than 15 feet and being greater than the width, the rooftop mechanical unit having first and second lengthwise sides and being supported on top of the roof by at least a first roof curb and a second roof curb, each of the first roof curb and the second roof curb having a length extending in a longitudinal direction, said length of each of the first and second roof curbs being at least 8 feet and less than 15 feet;

the first roof curb having a first wall extending at least 8 feet adjacent the first lengthwise side of the rooftop mechanical unit, the second roof curb having a first wall extending adjacent the first lengthwise side of the rooftop mechanical unit, a first side gap being provided between adjacent ends of the first roof curb first wall and the second roof curb first wall;

the first roof curb having a second wall extending at least 8 feet adjacent the second lengthwise side of the rooftop mechanical unit, the second roof curb having a second wall extending adjacent the second lengthwise side of the rooftop mechanical unit, a second side gap being provided between adjacent ends of the first roof curb second wall and the second roof curb second wall;

a first wind gap being provided which extends underneath the rooftop mechanical unit in a direction transverse to said longitudinal direction of the first and second roof curbs, ends of the first wind gap being defined by the first side gap and the second side gap.

2. The building according to claim 1, wherein the roof is a flat roof, the building is an enclosed building, and each of the first roof curb and the second roof curb is at least 10 feet in length.

3. The building according to claim 1, wherein the rooftop mechanical unit is selected from the group consisting of a fan, a ventilator, an air-conditioning unit, a refrigeration unit, a freezer unit, an air handling unit, an air makeup unit, a heat recovery unit, and a pollution control unit.

4. The building according to claim 1, wherein the rooftop mechanical unit has a length of at least 20 feet.

5. The building according to claim 1, wherein the rooftop mechanical unit has a length of at least 35 feet.

6. The building according to claim 1, wherein the first roof curb and the second roof curb have the same height, wherein the first wind gap has a height of at least 12 inches and not more than 52 inches and wherein the first wind gap has a width of at least 30 inches and not more than 106 inches.

7. The building according to claim 1, wherein the first wind gap has a width between the first and second roof curbs and a length perpendicular to the width and wherein the width is less than 50% of the length.

8. The building according to claim 1, wherein the building is situated in an area having a ground snow load of at least 15 pounds per square foot.

9. The building according to claim 1, wherein the rooftop mechanical unit has a weight of at least 100 pounds per foot of length.

10. The building according to claim 1, wherein the rooftop mechanical unit is further supported by a third roof curb, the second roof curb being located between the first roof curb and the third roof curb; a second wind gap being provided between the second roof curb and the third roof curb, the third roof curb being less than 15 feet in length.

11. The building according to claim 1, wherein the building is situated in an area which is subject to a local building code which provides, for that building, that, but for each of said roof curbs being less than 15 feet in length, the roof would have to be strengthened to support the addition of a drifted snow load.

12. A method of providing a rooftop mechanical unit on a roof of a building, comprising the following step:

(a) mounting or providing the rooftop mechanical unit on the roof of the building, the rooftop mechanical unit extending in a lengthwise direction and having a length and a width, the length being more than 15 feet and being greater than the width, the rooftop mechanical unit having first and second lengthwise sides and being supported on top of the roof by at least a first roof curb and a second roof curb, each of the first roof curb and the second roof curb having a length extending in a longitudinal direction, said length of each of the first and second roof curbs being at least 8 feet and less than 15 feet;

the first roof curb having a first wall extending at least 8 feet adjacent the first lengthwise side of the rooftop mechanical unit, the second roof curb having a first wall extending adjacent the first lengthwise side of the rooftop mechanical unit, a first side gap being provided between adjacent ends of the first roof curb first wall and the second roof curb first wall;

the first roof curb having a second wall extending at least 8 feet adjacent the second lengthwise side of the rooftop mechanical unit, the second roof curb having a second wall extending adjacent the second lengthwise side of the rooftop mechanical unit, a second side gap being provided between adjacent ends of the first roof curb second wall and the second roof curb second wall;

a first wind gap being provided which extends underneath the rooftop mechanical unit in a direction transverse to said longitudinal direction of the first and second roof curbs, ends of the first wind gap being defined by the first side gap and the second side gap.

13. The method according to claim 12, wherein the step of mounting or providing occurs during the construction of the building or during an addition of or a replacement of a rooftop mechanical unit on the roof of the building.

14. The method according to claim 12, wherein the roof is a flat roof, the building is an enclosed building, and each of the first roof curb and the second roof curb is at least 10 feet in length.

15. The method according to claim 12, wherein the rooftop mechanical unit is selected from the group consisting of a fan, a ventilator, an air-conditioning unit, a refrigeration unit, a freezer unit, an air handling unit, an air makeup unit, a heat recovery unit, and a pollution control unit.

16. The method according to claim 12, wherein the first roof curb and the second roof curb have the same height, wherein the first wind gap has a height of at least 12 inches and not more than 52 inches and wherein the first wind gap has a width of at least 30 inches and not more than 106 inches.

17. The method according to claim 12, wherein the building is situated in an area having a ground snow load of at least 15 pounds per square foot.

* * * * *